United States Patent [19]

Leber

[11] 4,232,918

[45] Nov. 11, 1980

[54] SUPPORT SYSTEM FOR FILING COMPUTER PAPER

[76] Inventor: Karl Leber, 369 Merton St., Toronto, Ontario, Canada M4S 1B3

[21] Appl. No.: 17,246

[22] Filed: Mar. 5, 1979

[30] Foreign Application Priority Data

May 5, 1978 [CA] Canada ..... 302889

[51] Int. Cl.[3] ..... A47B 63/00

[52] U.S. Cl. ..... 312/184; 24/86 R; 211/46; 402/36

[58] Field of Search ..... 312/183, 184; 211/46, 211/162; 281/45; 402/36; 24/86 R

[56] References Cited

U.S. PATENT DOCUMENTS

| | | | |
|---|---|---|---|
| 1,867,158 | 7/1932 | Kline | 312/184 |
| 4,056,296 | 11/1977 | Hedstrom et al. | 312/184 |

FOREIGN PATENT DOCUMENTS

| | | | |
|---|---|---|---|
| 105309 | 12/1956 | Netherlands | 312/184 |
| 619391 | 3/1949 | United Kingdom | 312/184 |

*Primary Examiner*—Casmir A. Nunberg
*Attorney, Agent, or Firm*—George H. Riches and Associates

[57] ABSTRACT

This invention relates to an improved suspension system for filing computer paper vertically in a file drawer or cabinet. A bundle of a desired number of sheets of paper may be filed using a system having a pair of assemblies, each of which has two members to engage the upper corners of the sheets of paper. The first member of each assembly has a flat panel-like portion which extends at an upper corner thereof to define a downwardly open hook and three vertically spaced horizontally extending prongs. The second member is flat and rectangular shaped and has three vertically spaced apertures which mate to receive the three prongs therethrough. The prongs of each first member are inserted through the upper three holes along one side of the computer paper, and the second member is then located on the prongs. This is repeated on the other side with the other assembly to hold the sheets of paper in a single bundle. The bundle is then located in the filing drawer and the outwardly projecting hook portions engage horizontal support bars to suspend the sheets of paper in the storage space. Sheets of paper may be added to or taken from any bundle in the drawer merely by easily manually removing the second member from each assembly and then replacing them after the sheets have been added or taken away. This system is very easy to use and extremely inexpensive to manufacture and the components are standard and interchangeable. In one embodiment, additional second members may be used to add more sheets to any bundle without separating the original members.

9 Claims, 5 Drawing Figures

FIG.1.
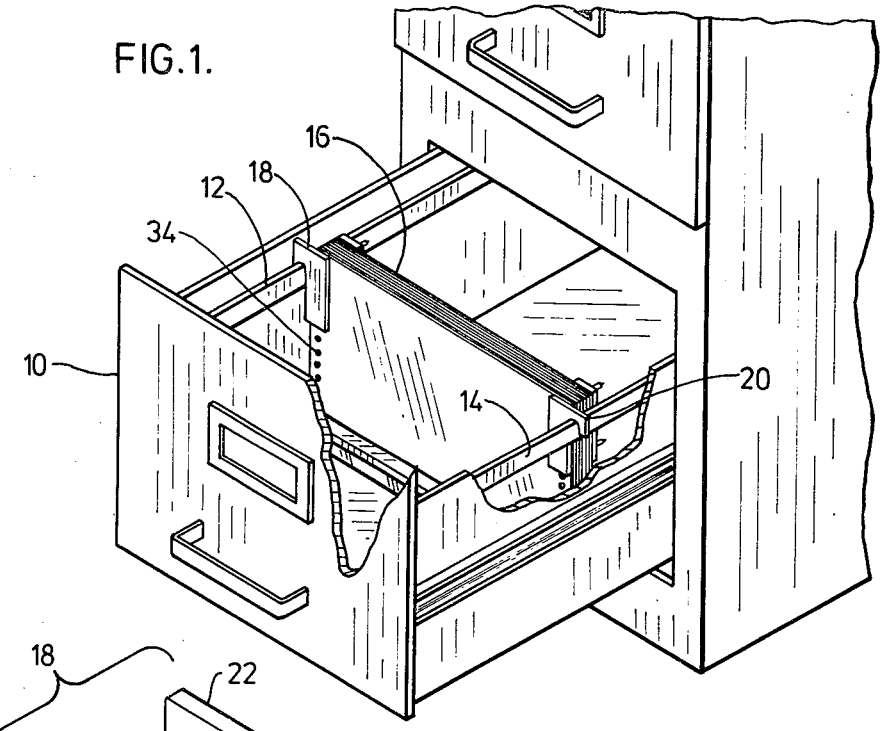
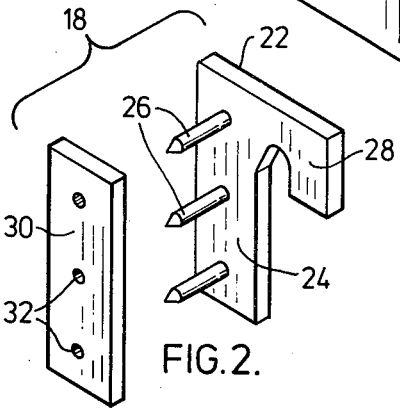
FIG.2.
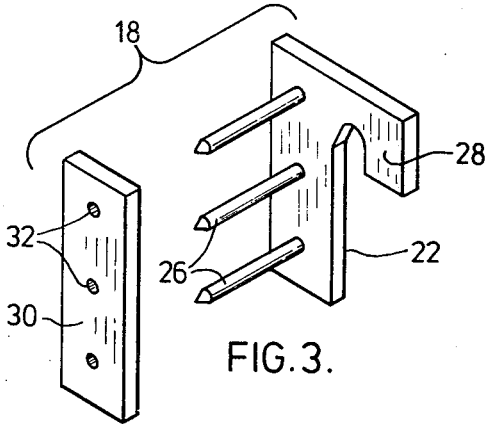
FIG.3.
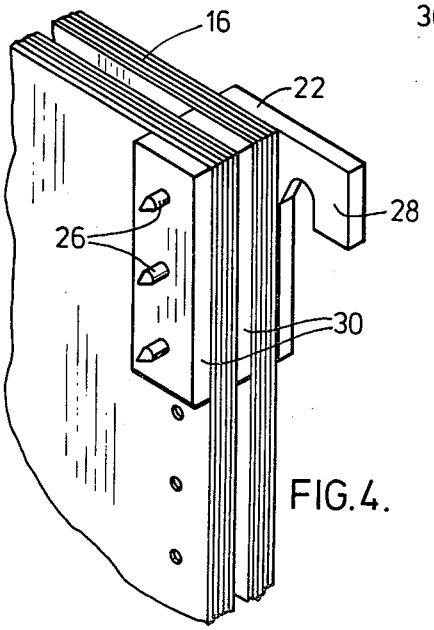
FIG.4.
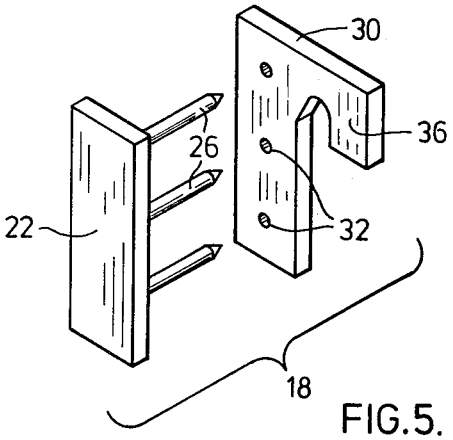
FIG.5.

SUPPORT SYSTEM FOR FILING COMPUTER PAPER

BACKGROUND OF THE INVENTION

This invention relates generally to paper filing apparatus and more particularly to a system for vertically filing a desired number of sheets of computer paper in a composite bundle in a conventional hanging folder file drawer.

In the past, file drawers having parallel horizontal bars along the front and rear or along both sides have been well known for suspending a plurality of hanging folders in a vertical relationship. The widespread use of computers has resulted in an enormous problem of storage of computer paper which is generally of a standard size with vertically spaced holes along each side. Hanging folders are not satisfactory for this purpose in view of the large quantities involved.

More recently, a variety of different types of holders and carriers have been proposed for specific use with computer paper which enable the sheets of paper to be retained in bundles outside of the filing drawer. One of these holders is disclosed in U.S. Pat. No. 4,056,296 which issued Nov. 1, 1977 to Wright Line Inc. While some of these previous devices operate satisfactorily, they have the serious disadvantage that they are relatively complex and costly to manufacture. This is a very significant factor in view of the extremely large quantities of paper involved. It is desirable that a desired number of sheets of stationery, such as computer paper, be retained together when they are removed from the file drawer, while providing for the quick and easy addition of one or more sheets to the bundle. It is also desirable that this be done with a suspension system formed of very inexpensive interchangeable components.

SUMMARY OF THE INVENTION

Accordingly, it is an object of the present invention to at least partially overcome these disadvantages by providing a stationery suspension system having a pair of assemblies for engaging the paper at each upper corner, each assembly having two members which may be quickly and easily manually engaged and disengaged to hold the paper.

To this end, in one of its aspect, the invention provides a stationery suspension system for filing a desired number of sheets of stationery having aligned holes vertically spaced along at least an upper portion of both sides thereof in a filing space having a pair of parallel spaced horizontally extending support bars, the suspension system comprising a pair of stationery engaging assemblies, each assembly having a first member with a plurality of vertically spaced parallel prongs extending therefrom, and a second member with a corresponding number of vertically spaced apertures therethrough, the prongs of the first member being adapted to be respectively received through a corresponding number of the holes along one side of the sheets of stationery, the apertures of the second member being adapted to respectively removably receive the prongs therethrough to retainably secure said one side of the sheets of stationery between the first and second members, one of the members of each assembly having a hook portion to engage a respective one of the support bars whereby the sheets of stationery may be vertically suspended together in the filing space.

In another of its aspects, the invention further provides a suspension system for filing computer paper having vertically spaced holes along both sides thereof in a filing drawer having a pair of upper parallel spaced horizontally extending support bars, the suspension system comprising a pair of paper engaging assemblies, each assembly having a first member with a flat panel-like portion which extends at an upper corner thereof to define a downwardly opening hook to engage a respective one of the support bars and three vertically spaced substantially cylindrical prongs extending horizontally therefrom; and a second flat rectangular member with three vertically spaced apertures therethrough, the second member mating the first member whereby the prongs of the first member may be respectively inserted through the apertures of the second member to frictionally removably secure the flat panel-like portion of the first member in a parallel relationship with the second member, whereby the prongs of the first member of each assembly may be first inserted through the three upper holes on a respective side of a desired number of sheets of computer paper, the second member of each assembly then manually located on the prongs of the respective first member to secure each upper corner of the sheets of computer paper between the first and second members of one of the assemlies to form a bundle of paper, and the bundle positioned in the drawer with the hooks of the first members of each assembly positioned over a respective one of the bars to vertically suspend the bundle in the drawer.

Further objects and advantages of the invention will appear from the following description taken together with the accompanying drawings.

BRIEF DESCRIPTION OF THE DRAWINGS

FIG. 1 is a perspective view of an old style file drawer showing the system according to a first embodiment of the invention in use to suspend a number of sheets of computer paper in the drawer;

FIG. 2 is a perspective view showing one of the assemblies of the system seen in FIG. 1;

FIG. 3 is a perspective view showing one of the assemblies of the system according to a second embodiment of the invention;

FIG. 4 is a perspective view showing an additional function of the suspension system according to the invention; and FIG. 5 is a perspective view showing one of the assemblies of the system according to a further embodiment of the invention.

BRIEF DESCRIPTION OF THE PREFERRED EMBODIMENTS

Reference is first made to FIG. 1 which shows a file drawer 10 having a pair of horizontal bars 12, 14 extending along the upper sides thereof as would be used in a conventional hanging folder filling system. While these support bars 12, 14 may be of a variety of different forms depending upon the filing drawer or cabinet, they do extend horizontally parallel to each other and have a standard spacing. The bundle of sheets of computer paper 16 is suspended in the drawer 10 by the system according to the invention having a pair of assemblies 18, 20 which engage the paper at the respective upper corners thereof. While the bundle is shown to most clearly illustrate the assemblies, it is apparent that it may be reversed end to end to face the other way if desired.

As seen in FIG. 2, each assembly has a first member 22 which has a flat portion 24 with three vertically spaced prongs 26 extending horizontally therefrom. The prongs are of equal length and cylindrical shaped with pointed ends. The flat panel-like portion 24 is generally rectangular shaped with a downwardly open hook portion 28 extending from one upper corner thereof. A second member 30 is flat and rectangular shaped to match the first member and has three vertically spaced apertures 32 therethrough. As may be seen, these apertures are located and shaped to receive the three prongs 26 of the first member 22 which may be easily inserted therethrough. As will be appreciated, these components may be very inexpensively manufactured from suitable plastic materials in large quantities.

In use, the standard sized sheets of computer paper have vertical spaced holes 34 along each side and a desired number of these sheets are assembled in a bundle with these holes 34 aligned. The prongs 26 of the first member 22 are then manually inserted through the upper three holes on one side of the paper and a second member 30 is then located with the portions of the prongs 26 which extend through the sheets of the paper being mateably received through the apertures 32 in the second member. The second member 30 and the flat portion 24 of the first member 22 are manually pressed together to draw the corners of the sheets of the bundle together which may slightly compress them and exert an outward force on the members of the assembly. Frictional and angular engagement of the prongs 26 of the first member 22 in apertures 32 of second member 30 retain the members in this position until they are manually manipulated to separate them. This is then repeated with another assembly at the other upper corner of the sheets, with the two assemblies being identical except that the hook portions 24 of the first members extend in opposite directions. Thus, the pair of assemblies 18, 20 engage the upper corners of the sheets of computer paper to retain them in a bundle which may be moved about very conveniently. In order to store the bundle 16 in a file drawer or cabinet, it is merely positioned in the drawer as shown in FIG. 1 with the outwardly projecting hook portions 28 engaging the horizontal bars 12, 14 to suspend the bundle in a vertical position. In order to quickly and easily add or remove a sheet or sheets, the flat second members are manually separated from the respective first members, the appropriate sheets added or removed, and the assemblies then pressed back together. In some instances, this may be dome without even removing the bundle from the filing space.

FIG. 3 illustrates the structure of an assembly according to a second embodiment of the invention, and as many of the features are identical to those of the first embodiment, features common to both embodiments are described and illustrated using the same reference numberals. In this embodiment, the first and second members 22, 30 are identical to those of the embodiment shown in FIG. 2 with the exception that the three prongs 26 are longer. This permits a greater number of sheets to be held in a single bundle and also allows for the use of multiple second members 30, as illustrated in FIG. 4. It will be evident to any one familiar with office practice but initially only a single sheet or small number of sheets may be stored in any particular bundle, depending upon subject classification and other matters. Then at a later date it may be desired to add more sheets to the bundle. This may quickly and easily be done by separating the two second members 30 from the first members 22, positioning the additional sheets on the prongs, and then replacing the second members 30. Alternatively, this may be done even more quickly by locating the additional sheets on the prongs 26 without removing the second member 30 and then positioning other second members 30 over the prongs, as shown in FIG. 4. This procedure might be adopted with a small number of sheets and could be repeated until there is no more space on the prongs. Then it would be necessary to withdraw the sheets from the prongs, remove the excess second members 30 and relocate the sheets back on the prongs in a single bundle with only one second member 30 on each set of prongs. Use of multiple second members is facilitated by the fact that the second members for both sides are identical and they are very economical to produce in mass quantities.

FIG. 5 illustrates a further embodiment of the invention in which a hook portion 36 is located on the second member 30 rather than on the first member 22. The use of this embodiment of the invention is similar to that of the first and second embodiment given above and need not be described further. While this is a variation of the invention to be covered by this application it will be apparent that it normally is not as convenient to use as the embodiments with the hook portion and prongs on the same member.

Although the description of this suspension system has been given with respect to particular embodiments, it is not to be construed in any limiting sense. Many variations and modifications will now occur to those skilled in the art. For instance, the prongs and apertures may be of different shapes and different spacings to be suitable for storing other types of stationery. Furthermore, it is apparent that the shape of one or both of the members of each assembly could be varied, if desired. For a definition of the invention, reference is made to the appended claims.

What I claim is:

1. A stationery suspension system for filing a desired number of sheets of stationery having aligned holes vertically spaced along at least an upper portion of both sides thereof in a filing space having a pair of parallel spaced horizontally extending support bars, the suspension system comprising:

a pair of stationery engaging assemblies, each assembly having a first member with a plurality of vertically spaced parallel prongs extending therefrom, and a second member with a corresponding number of vertically spaced apertures therethrough, the prongs of the first member being adapted to be respectively received through a corresponding number of the holes along one side of the sheets of stationery, the apertures of the second member being adapted to respectively removably receive the prongs therethrough to retainably secure said one side of the sheets of stationery between the first and second members, one of the members of each assembly having a hook portion to engage a respective one of the support bars whereby the sheets of stationery may be vertically suspended together in the filing space.

2. A stationery suspension system as claimed in claim 1 wherein the first member has a flat portion with the prongs extending horizontally from one side surface thereof, and the second member is flat with the matching apertures therethrough, the flat portion of the first member and the second member being drawn towards each other in a parallel relationship when the prongs of the first member are received in the apertures of the second member.

3. A stationery suspension system as claimed in claim 2 wherein one of the second member and the flat portion of the first member extends at an upper corner thereof to define the hook portion with a downwardly open recess to receive the respective one of the support bars.

4. A stationery suspension system as claimed in claim 3 wherein the hook portion extends from the flat portion of the first member, and the second member is rectangular shaped.

5. A stationery suspension system as claimed in claim 3 wherein each assembly further includes a third member identical to the second member which may be located on the prongs of the first member to retain additional sheets of holed stationery with out disassembling the first and second members of each assembly.

6. A stationery suspension system as claimed in claim 1, wherein the first member has three prongs and the second member has three apertures.

7. A stationery suspension system as claimed in claim 1, wherein the prongs of the first member are frictionally engaged in the apertures of the second member.

8. A stationery suspension system as claimed in claim 1, wherein the prongs are substantially cylindrically shaped.

9. A suspension system for filing computer paper having vertically spaced holes along both sides thereof in a filing drawer having a pair of upper parallel spaced horizontally extending support bars, the suspension system comprising:

a pair of paper engaging assemblies, each assembly having a first member with a flat panel-like portion which extends at an upper corner thereof to define a downwardly opening hook to engage a respective one of the support bars and three vertically spaced substantially cylindrical prongs extending horizontally therefrom; and a second flat rectangular member with three vertically spaced apertures therethrough, the second member mating the first member whereby the prongs of the first member may be respectively inserted through the apertures of the second member to frictionally removably secure the flat panel-like portion of the first member in a parallel relationship with the second member, whereby the prongs of the first member of each assembly may be first inserted through the three upper holes on a respective side of a desired number of sheets of computer paper, the second member of each assembly then manually located on the prongs of the respective first member to secure each upper corner of the sheets of computer paper between the first and second members of one of the assemblies to form a bundle of paper, and the bundle positioned in the drawer with the hooks of the first members of each assembly positioned over a respective one of the bars to vertically suspend the bundle in the drawer.

* * * * *